United States Patent [19]

Dreier et al.

[11] Patent Number: 4,458,812

[45] Date of Patent: Jul. 10, 1984

[54] REAGENT STORAGE VESSEL

[75] Inventors: Gustav H. Dreier, Acton; Larry Sorenson, Waltham, both of Mass.

[73] Assignee: Instrumentation Laboratory, Inc., Lexington, Mass.

[21] Appl. No.: 406,538

[22] Filed: Aug. 9, 1982

[51] Int. Cl.[3] ..... B04B 5/00; B65D 25/08

[52] U.S. Cl. ..... 206/221; 206/219; 220/307; 494/38; 494/43; 494/44

[58] Field of Search ..... 206/219, 220, 221, 222, 206/568, 569; 494/1, 24, 28, 38, 43, 44; 220/307

[56] References Cited

U.S. PATENT DOCUMENTS

| | | | |
|---|---|---|---|
| 3,291,387 | 12/1966 | Billen | 233/28 |
| 3,332,572 | 7/1967 | Green | 220/307 |
| 3,415,361 | 12/1968 | Adams, Jr. et al. | 206/221 |
| 3,415,627 | 12/1968 | Rait | 23/253 |
| 3,497,320 | 2/1970 | Blackburn et al. | 23/230 |
| 3,504,376 | 3/1970 | Bednar et al. | 23/230 |
| 3,530,981 | 9/1970 | Wienecke, Jr. | 220/307 |
| 3,681,029 | 8/1972 | Shapiro | 23/259 |
| 3,718,439 | 2/1973 | Rosse et al. | 23/259 |
| 3,795,451 | 3/1974 | Mailen | 356/246 |
| 3,817,420 | 6/1974 | Heisler | 220/307 |
| 3,902,660 | 9/1975 | Barber | 233/26 |
| 4,020,832 | 5/1977 | Kirpatrick et al. | 206/219 |
| 4,056,225 | 11/1977 | Hein | 233/20 |
| 4,111,355 | 9/1978 | Ishimaru | 494/38 |
| 4,142,670 | 3/1979 | Ishimaru et al. | 494/38 |
| 4,177,921 | 12/1979 | Nielsen | 233/20 |
| 4,227,810 | 10/1980 | Sandrock et al. | 356/246 |
| 4,239,853 | 12/1980 | Bradley | 435/33 |

*Primary Examiner*—George E. Lowrance
*Assistant Examiner*—Jimmy G. Foster

[57] ABSTRACT

A durable, low cost, disposable, single test reagent package with plural compartments that maintain reagents separate during long term storage and permits combining of compartment contents without opening the vessel in a simple, rapid, and controlled manner includes a body component and an imperforate cooperating cover component. The body component defines a central compartment and an annular compartment surrounding the central compartment. Each compartment is upwardly open with annular ridge structure between the two compartments, and reagent material is stored in at least one of the compartments. The cooperating cover component has peripheral rim structure that is sealingly attached to cooperating rim structure of the body component to provide an hermetically sealed vessel, and includes integral depending annular seal structure for reclosable sealing engagement with the annular ridge structure of the body component and annular flexible web structure that permits movement of the seal structure between a position in sealing engagement with the annular ridge structure and an open position in which reagent material in the central compartment may be flowed under centrifugal force over the annular ridge into the annular compartment while the package remains sealed.

14 Claims, 9 Drawing Figures

FIG 1
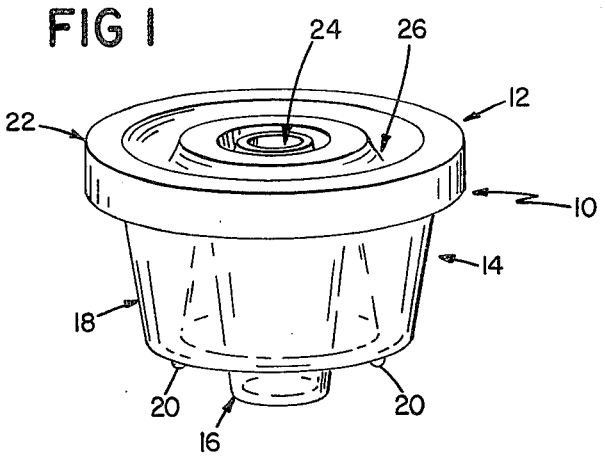
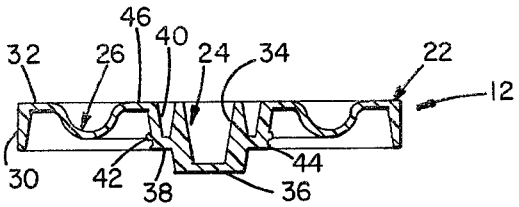
FIG 2
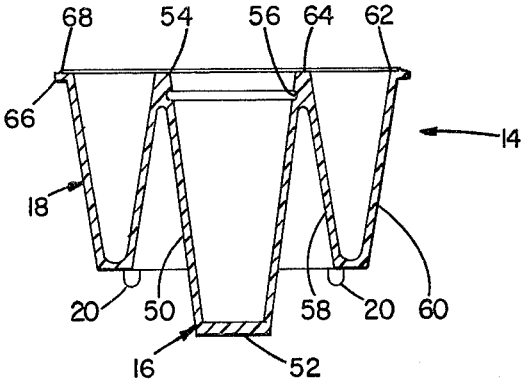
FIG 4
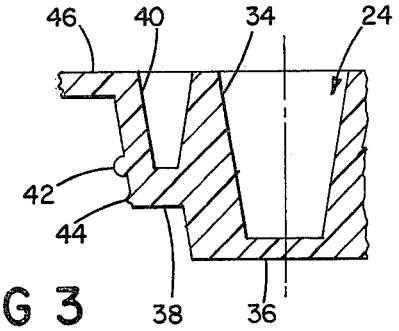
FIG 3
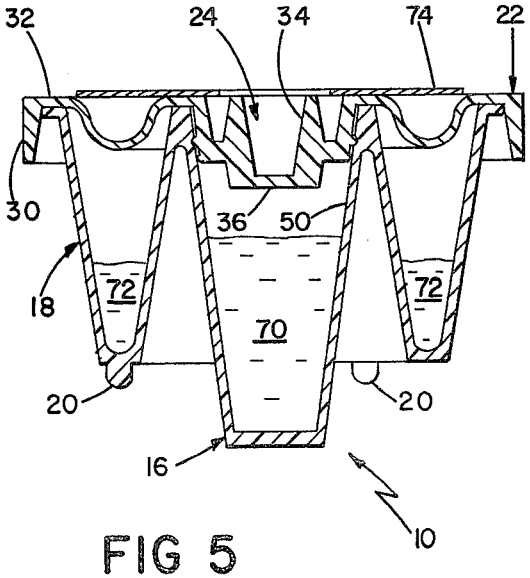
FIG 5
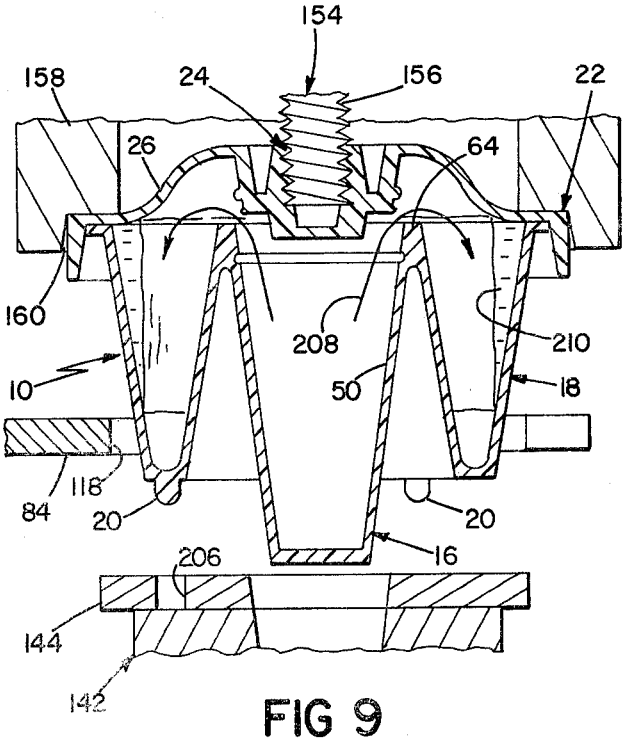
FIG 9

FIG 6
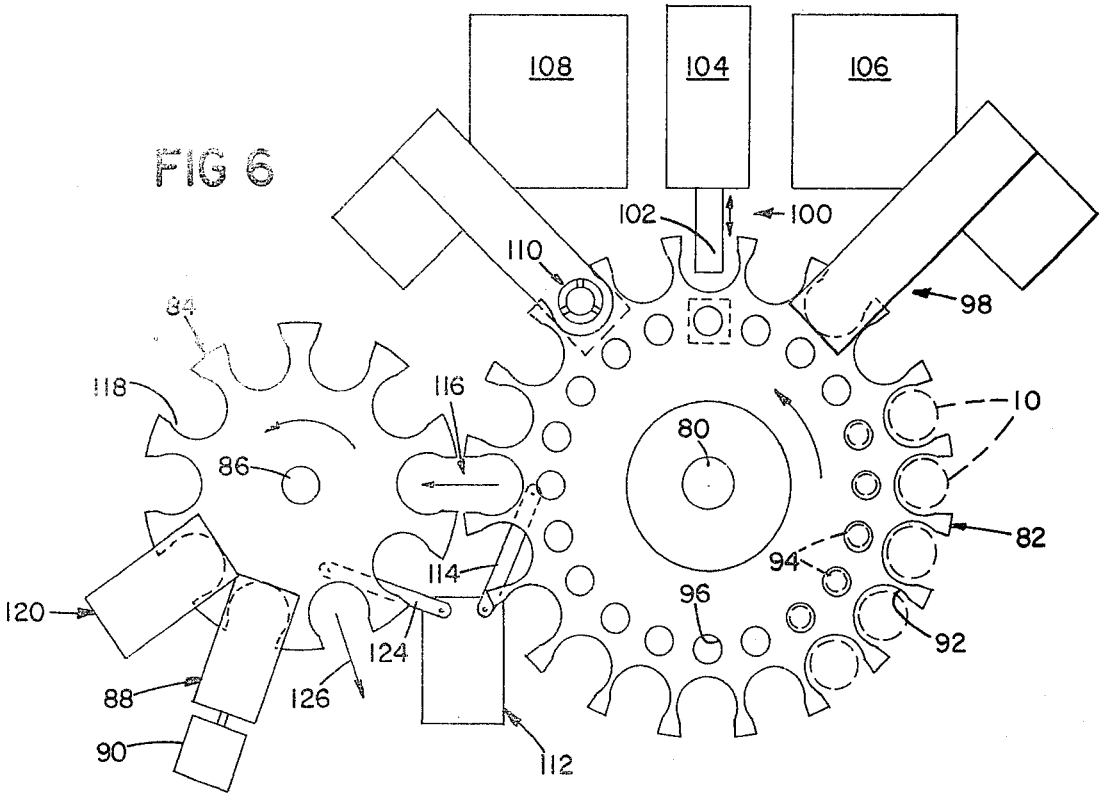
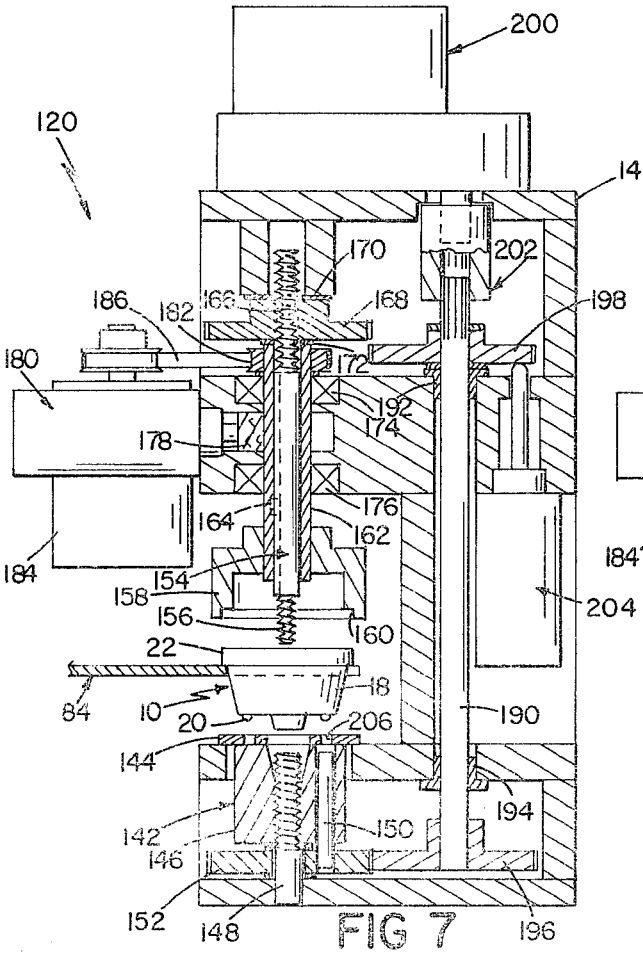
FIG 7
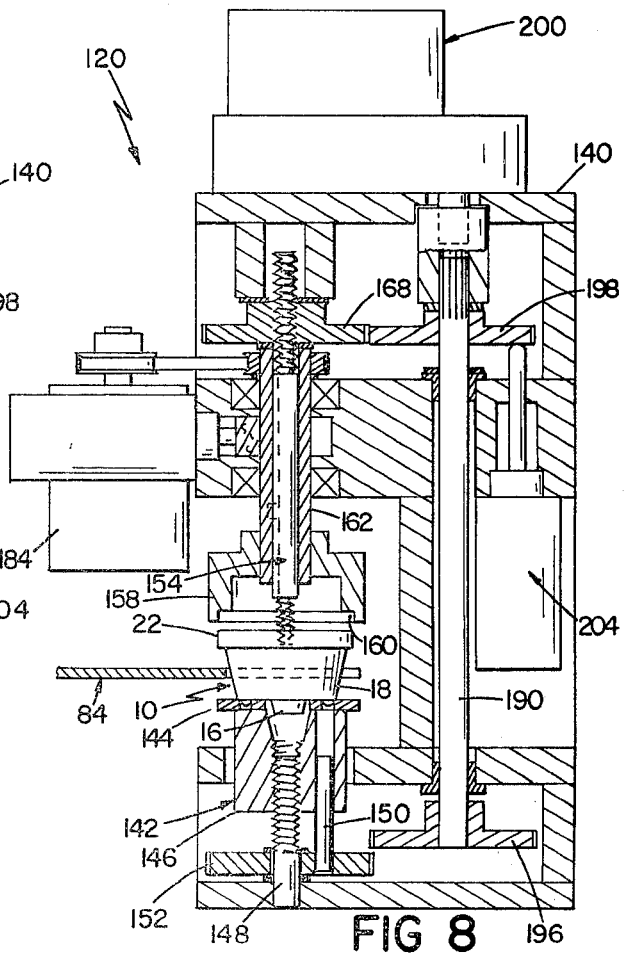
FIG 8

REAGENT STORAGE VESSEL

This invention relates to automated chemical analyzers and more particularly to packages for storing reagents for use in such analyzers.

A variety of plural compartment reagent vessels for use with various types of analyzers have been proposed. Among those proposals are vessels of the type shown in U.S. Pat. Nos. 3,497,320 and 3,718,439 in which reagents are stored in separate compartments without fluid communication therebetween; centrifugal analyzer rotors of the type shown in U.S. Pat. Nos. 3,795,451 and 4,226,531 in which inner and outer concentric arrays of compartments are provided with passages therebetween for flow of reagent materials from the inner compartments to radially aligned outer compartments; centrifuge rotor liners of the type shown in U.S. Pat. No. 4,177,921 which have an open central compartment and a sealing flap which is opened under centrifugal force; and reagent storage vessels of the type shown in U.S. Pat. No. 4,227,810 that have a passage of capillary dimension between separate compartments for restricting the mixing of reagents stored in those compartments.

In accordance with the invention, there is provided a disposable, plural compartment reagent storage vessel or package that includes a body component that defines a central compartment of inverted frustoconical configuration, an annular compartment surrounding the central compartment, and rim structure outwardly of the annular compartment. Each compartment is upwardly open with annular ridge structure between the two compartments, and reagent material is stored in at least one of the compartments. An imperforate cooperating cover component has peripheral rim structure that is sealingly attached to cooperating rim structure of the body component to provide an hermetically sealed vessel. The cover member includes integral depending annular seal structure for reclosable sealing engagement with the annular ridge structure of the body component and annular flexible web structure that permits movement of the seal structure between a position in sealing engagement with the annular ridge structure and an open position in which reagent material in the central compartment may be flowed under centrifugal force over the annular ridge into the annular compartment while the vessel remains sealed.

The invention provides a durable, low cost, disposable, single test reagent package with plural compartments that maintain reagents separate during long term storage and permits combining of compartment contents without opening the vessel in a simple, rapid, and controlled manner. The reagents may be in liquid or powder form, and the package permits reconstitution of powdered reagents in either or both compartments during processing in the analyzer. The cover may include puncturable wall structure that permits access to either or both compartments as by means of a probe, and visual and/or machine readable information may be provided on the vessel as by means of a label.

In particular embodiments, the compartments of the package are rotationally symmetrical such that contents of the central compartment may be transferred to said annular compartment by centrifugal force, and each of the compartments has a volume in the order of about one cubic centimeter. The central compartment has an annular wall surface that slopes upwardly and outwardly at an angle of about ten degrees along which the contents of the central compartment are flowed under the influence of centrifugal force for transfer to the outer annular compartment, and the seal structure includes an annular seal lip for wiping engagement with that outwardly sloping wall surface of the central compartment. The cover and body components also include cooperating recess and projection portions for latching the seal lip in sealing engagement with that sloping wall surface. In a particular embodiment, a mechanical mechanism that cooperates with a socket in the package cover opens and recloses the compartment seal, but package manipulating mechanisms for opening the compartment seal that may be electrically, hydraulically, pneumatically, or otherwise operated as appropriate for particular applications may also be employed.

The invention provides a hermetically sealed disposable reagent storage package for storing reagents for use in a chemical analyzer in which the contents of two or more compartments may be maintained in isolation from one another for shelf lives of six months and more, the contents of the compartments being readily transferred for mixing and reaction immediately prior to analysis by centrifugal force without unsealing the package.

Other features and advantages of the invention will be seen as the following description of a particular embodiment progresses, in conjunction with the drawings, in which:

FIG. 1 is a perspective view of a reagent storage package in accordance with the invention;

FIG. 2 is a sectional view of the cover component of the reagent package shown in FIG. 1;

FIG. 3 is an enlarged view of a portion of the cover component;

FIG. 4 is a sectional view of the body component of the reagent package shown in FIG. 1;

FIG. 5 is a sectional view of the assembled cover and body components;

FIG. 6 is a diagrammatic view of analyzer apparatus for use with the reagent package shown in FIG. 1;

FIG. 7 is an elevational view of package manipulation apparatus used in the analyzer apparatus shown in FIG. 6;

FIG. 8 is an elevational view similar to FIG. 7, showing the package manipulation apparatus in a second position; and FIG. 9 is a sectional view showing reagent transfer action within the sealed package of FIG. 1.

DESCRIPTION OF PARTICULAR EMBODIMENT

With reference to FIG. 1, the sealed plural compartment package 10 includes cover component 12 of injection molded low density polyethylene and body component 14 also of injection molded low density polyethylene. Body component 14 defines a central compartment 16 of about one and one-half milliliter volume and a surrounding annular compartment 18 also of about one and one-half milliliter volume. Drive lugs 20 are formed at the base of outer compartment 18. Cover component 12 has a diameter of about three centimeters and includes annular rim portion 22 that is ultrasonically welded to a cooperating rim portion of body component 14. Formed at the center of cover component 12 is socket structure 24 for receiving a mechanical, package manipulating operator member. Annular flexible web 26 connects central socket structure 24 with rim structure 22.

Further details of cover component 12 may be seen with reference to FIGS. 2 and 3. Rim structure 22 include an annular depending flange 30 of about one-thrid centimeter height and flange 32 that extends radially inward. Central socket portion 24 defines a socket wall 34 that is about one-third centimeter in diameter and one-half centimeter in depth with a probe puncturable base wall **36*b* that is about one-half millimeter thick. Extending outwardly from socket wall 34 is flange 38 which carries annular web 40, on the outer surface of which is formed latch ridge 42 and annular wiping seal lip 44 (FIG. 3). At the top of web 40 is an outwardly extending flange 46. Hinge web 26 (of about one-half millimeter thickness) is of generally U-shaped cross-section and extends from flange 46 to rim flange 32** and has a radial width of about three-fourths centimeter and a trough depth of about one-quarter centimeter.

With reference to FIG. 4, central compartment 16 of body component 14 is about two centimeters deep and is defined by wall 50 that is included outwardly at an angle of about eight degrees from base wall 52 to a port 54 at its upper edge that has a diameter of about one centimeter. Formed in the inner surface of wall 50 is latch groove 56. Outer compartment 18 is defined by inner and outer annular walls 58, 60 which diverge upwardly from one another at an angle of about twenty degrees and define, at upper edge 62, an annular opening of about 0.6 centimeter radial width. Annular ridge 64 separates compartments 16 and 18 and formed on annular rim 66 is an annular ridge 68 for ultrasonic welding of rim 66 to cover flange 32.

After reagent materials 70, 72 have been introduced into one or both of compartments 16, 18, package 10 is sealed by seating rim flange 32 of cover component 12 on rim 66 of body component 14 and forming an hermetic seal by ultrasonic welding. The resulting reagent package, as shown in FIGS. 1 and 5 is hermetically sealed with the reagent materials 70, 72 in compartments 16 and 18 sealed from one another by the seal lip 44 which is seated in wiping engagement against wall surface 50 and latched in position by interengagement of rib 42 and groove 56 as shown in FIG. 5. Visual and/or machine readable information may be provided on package 10 as by means of label 74 secured to cover 12.

Analyzer apparatus of the type with which the package shown in FIGS. 1–5 may be used is illustrated in FIG. 6. That apparatus includes a preparation region with a drive 80 for receiving a sample tray 82, and a mixer region 84 that includes a rotary drive 86. Sampling apparatus 88 is adapted to transfer a sample after mixing from a reaction package 10 to an analysis region 90. Sample tray 82 has a series of twenty U-shaped recesses 92, equally spaced about its periphery, into which reagent packages 10 are placed such that they are supported by rim flanges 30. Sample cups 94 are inserted into a circumferential array of twenty holes 96 adjacent to and radially inward from the reagent package receiving recesses 92. Tray 82 is normally loaded at a bench and then placed onto the rotary drive mechanism (diagrammatically indicated at 80) within the analyzer. Disposed adjacent drive mechanism 80 is a bar code reader 98, a probe mechanism 102 and probe drive mechanism 104, sample pump 106, diluent pump 108, and agitator mechanism 110. Transfer mechanism 112 includes lever arm 114 which operates to slide a reagent package 10 from sample tray 82 at position 116 to transport disc 84 and lever arm 124 which operates to slide a reagent package from disc 84 after analyzer disc 84 has an outer array of ten package receiving recesses 118 about its periphery. Disposed adjacent the periphery of transfer disc 84 are mixer unit 120, sampling apparatus 88 and ejection arm 124 which operates to eject each reagent package 10 and to a waste receptacle, as indicated by arrow 126.

In an illustrative analyzer sequence, after sample tray 82 has been loaded and positioned on drive mechanism 80, that mechanism indexes the reagent packages 10 to reader mechanism 98 to identify the processing parameters for the test reagents in that reagent package. Tray 82 is then indexed to probe station 100 and the sample probe 102, as driven by its controller 104 and in accordance with information supplied by reader 100, is moved over sample cup 94 to pick up a programmed quantity of sample, then to move radially outward to the reagent package 10 at station 100 and deposit programmed amounts of sample and/or diluent into one or both compartments 16, 18 in that reagent package, and then to fully retracted position for washing. When the probe is positioned over a reagent package, the probe drive mechanism 104 moves the probe down and punctures the cover 12, sample is dispensed and the probe is washed with diluent, and the probe is withdrawn, the cover material tending to reclose the puncture. Sample tray 82 is next indexed to agitator station 110 where the package 10 is spun in alternate clockwise and counterclockwise directions for mixing liquid reagents and dissolving powdered reagents. Sample tray 82 is next indexed to transfer station 116 where transfer arm 114 is operated to slide the reagent package 10 from sample tray 82 to transport disc 84. Transport disc 84 is rotated counterclockwise at a fixed incremental rate (one position every twenty seconds).

Further details of the mixer unit 120 may be seen with reference to FIG. 7. That apparatus includes frame structure 140 in which an opening is defined for receiving reagent package 10 as transported by transport disc 84. Jack assembly 142 at the base of that opening carries a drive disc 144 and includes body member 146 which is threadedly mounted on fixed shaft 148. Pin 150 rotationally couples body member 146 to spur gear 152. Disposed on the upper side of the opening in alignment with jack mechanism 142 is a vertically movable mandrel member 154 with a threaded end portion 156 for engaging package socket 24 and a hold down member 158 which has an annular seat 160 for receiving rim 22 of the reagent package 10 after it is lifted from transport disc 84. It will be apparent that other package manipulating mechanisms for opening the compartment seal may be employed. Such manipulating mechanisms may be electrically, hydraulically, pneumatically, or otherwise operated as appropriate for particular applications.

Restraint ring 160 is supported from the lower end of drive sleeve 162, and mandrel shaft 154 is mounted for axial reciprocating motion with sleeve 162. Key 164 guides the axial motion of shaft 154 relative to sleeve 162. The upper end 166 of mandrel shaft 154 is threaded, and spur gear 168 is threaded on shaft end 166 and maintained in axial position by fixed bearing members 170, 172. Drive sleeve 162 is mounted for rotation in bearings 174, 176 and is fixed in position by latch 178 controlled by solenoid mechanism 180. A drive mechanism for sleeve 162 includes sleeve pulley 182 which is connected to drive motor 184 by drive belt 186.

Drive shaft 190 has its axis parallel to mandrel shaft 154 as supported by bushings 192, 194. Secured on drive shaft 190 are spur gears 196, 198, and shaft 190 is movable between a lower position (as shown in FIG. 7) in which gears 152 and 196 are in engagement, and an upper position (shown in FIG. 8) in which gears 168 and 198 are in engagement. Drive shaft 190 is coupled to gear motor 200 by spline 202. A solenoid drive (diagrammatically indicated at 204) moves drive shaft 190 between its upper and lower positions.

In an operating sequence of manipulation apparatus 120, gear 196 is initially in engagement with gear 152. When transport disc 84 indexes a reagent package 10 into alignment between jack mechanism 142 and mandrel shaft 154, gear motor 200 is energized to rotate drive shaft 190 and raise jack mechanism 142. As jack mechanism 142 moves upward, drive lugs 20 of the reagent package 10 are received in drive recesses 206 of drive disc 144. As the jack mechanism 142 continues to move upward, package 10 is lifted from transport disc 84 with a rotating motion that engages mandrel threads 156 with socket 24.

After jack mechanism 142 has lifted package 10 to the position shown in FIG. 8, mandrel 154 is secured to socket 24 by threads 156. In this position, drive shaft 190 is shifted by mechanism 204 to disengage gear 196 and to engage gear 198 with mandrel gear 168. In this position, gear motor 200 rotates drive shaft 190, and mandrel shaft 154 is moved vertically, lifting reagent package 10 from jack mechanism 142 and drive disc 144, and seating rim 22 in stop recess 160. Further upward movement of mandrel shaft 154 lifts the center of cover 122, pulling the latch seal 44 upwardly to the position generally as shown in FIG. 9. In that position, inner compartment 16 is in communication with outer compartment 18 along a path generally indicated by arrows 105 over annular ridge 64, while the reagent package remains sealed.

In this condition, drive shaft 190 is lowered to disengage gears 168 and 198; latch mechanism 178 is released; and drive motor 184 is energized to spin the drive sleeve 162 with attached reagent package 10, causing the contents 70 of inner compartment 16 to flow up the conical wall 50 and over annular ridge 64 into outer compartment 18 for mixing with reagent material 72, producing a mixture 210 as indicated in FIG. 9. Motor 184 is then deenergized and the sleeve assembly is locked against rotation by latch 178. Drive shaft 190 is moved up to reengage gears 168 and 198, and gear motor 200 is energized to drive the mandrel 154 downwardly, reseating package 10 on drive disc 144 and reclosing the cover seal 44 with latch rib 42 being reseated in groove 56. Drive shaft 190 is then shifted to its lower position and jack mechanism 142 is rotated to release package 10 from the threads 156 of mandrel shaft 154 so that package 10 returns to transport disc 84.

Disc 84 is then indexed to probe station 88 where a stainless steel probe pierces cover 12 and enters outer compartment 18 to withdraw the reagent mixture 210 from compartment 18 into analysis cuvette 90 where a photometric measurement is performed. When transport disc 84 is next indexed, ejection mechanism 113 moves ejection arm 124 to eject the package 10 to a waste receptacle as indicated by arrow 126.

While a particular embodiment of the invention has been shown and described, various modifications thereof will be apparent to those skilled in the art and therefore it is not intended that the invention be limited to the disclosed embodiment or to details thereof, and departures may be made therefrom within the spirit and scope of the invention.

What is claimed is:

1. A sealed disposable reagent storage package comprising a body component including structure defining a central compartment and an annular compartment surrounding said central compartment, each said compartment being upwardly open with annular ridge structure between said compartments, said body component having structure interconnecting said compartments and rim structure outwardly of said annular compartment; reagent material in at least one of said compartments; and an imperforate cover component including structure defining annular rim structure sealingly attached to the rim structure of said body component to provide a sealed enclosure that houses said compartments and said reagent material, said cover component further including latchable seal structure that, in latched sealing engagement with said annular ridge structure, prevents flow of material between said central and annular compartments, and an annular flexible web connected to and extending between said rim structure and said seal structure that permits movement of said seal structure while said package remains sealed between said latched position in engagement with said annular ridge structure and a released position spaced from said annular ridge structure that permits flow of material from said central compartment over said annular ridge structure into said annular compartment.

2. The package of claim 1 wherein said imperforate cover member is formed of probe puncturable polymeric material.

3. The package of claim 2 wherein said polymeric material is low density polyethylene and the rim portions of said body and cover components are ultrasonically welded together.

4. The package of claim 1 and further including mechanical coupling structure radially inward of said annular seal structure for mechanical attachment to package manipulating apparatus for moving said seal structure between said latched and said open positions.

5. The package of claim 4 wherein said coupling structure includes socket structure in said cover component.

6. A hermetically sealed disposable reagent storage package for storing a reagent for use in a chemical analyzer comprising a body component and a cover component sealingly attached together to define a sealed container, said body component including structure defining a central compartment and an annular compartment surrounding said central compartment, each said compartment being upwardly open, said body component including structure interconnecting said compartments and annular ridge structure between said compartments, said body member having a rim portion outwardly of said annular compartment, reagent material in at least one of said compartments, said cover component including structure defining a cooperating rim portion sealingly attached to the rim portion of said body component, said cover component further including annular seal structure having a sealing position sealing said compartments and preventing the flow of material from one compartment to the other, and an annular flexible web connected to and extending between said rim structure and said seal structure that permits movement of said seal structure between said sealing position and an open position that permits flow of material from said central compartment over said annular ridge structure into said annular compartment while said package remains sealed.

7. The package of either claim 1 or 6 wherein said central compartment has an annular outwardly sloping wall surface, said seal structure includes an annular seal lip for engagement with said outwardly sloping wall surface of said central compartment, and said cover and body components include cooperating latch portions for latching said seal lip in sealing engagement with said sloping wall surface.

8. The package of either claim 1 or 6 wherein said compartments are rotationally symmetrical such that contents of said central compartment may be transferred to said annular compartment by centrifugal force when said seal structure is in said open position.

9. The package of either claim 1 or 6 wherein each of said compartments has a volume of less than five cubic centimeters.

10. The package of claim 6 wherein said compartments are rotationally symmetrical such that contents of said central compartment may be transferred to said annular compartment by centrifugal force, each of said compartments has a volume of about one cubic centimeter, said central compartment has an annular wall surface that slopes upwardly and outwardly at an angle of at least about ten degrees, and said seal structure includes an annular seal lip for engagement with said outwardly sloping wall surface of said central compartment, and said cover and body components include cooperating recess and projection portions for latching said seal lip in sealing engagement with said sloping wall surface.

11. A sealed disposable reagent storage package comprising a body portion including structure defining a central compartment and an annular compartment surrounding said central compartment, each said compartment being upwardly open, said body portion including structure interconnecting said compartments and annular ridge structure between said compartments; reagent material in a least one of said compartments; and an imperforate cover portion sealingly attached to said body portion so that a sealed enclosure that houses said compartments and said reagent is provided, annular seal structure carried by said cover portion and movable between a seal position in sealing engagement with said annular ridge structure that prevents flow of material between said central and annular compartments and an open position spaced from said annular ridge structure that allows flow of material over said annular ridge structure between said central and annular compartments while said package remains sealed, and an annular flexible web connected to and extending radially outwardly from said seal structure that permits movement of said seal structure relative to said body portion between said seal position and said open position.

12. The package of claim 11 wherein said seal structure includes an annular seal lip for engagement with said annular ridge structure, and said cover and body portions include cooperating latch portions for latching said seal lip in sealing engagement with said annular ridge structure.

13. A sealed disposable reagent storage package comprising a body portion including structure defining a central compartment and an annular compartment surrounding said central compartment, each said compartment being upwardly open, said body portion including structure interconnecting said compartments and annular ridge structure between said compartments; reagent material in at least one of said compartments; and an imperforate cover portion sealingly attached to said body portion so that a sealed enclosure that houses said compartments and said reagent is provided, annular seal structure carried by said cover portion and movable between a seal position in sealing engagement with said annular ridge structure that prevents flow of material between said central and annular compartments and an open position spaced from said annular ridge structure that allows flow of material over said annular ridge structure between said central and annular compartments while said package remains sealed, said seal structure including an annular seal lip for engagemnet with said annular ridge structure, said cover and body portions including cooperating latch portions for latching said seal lip in sealing engagement with said annular ridge structure, and an annular flexible web connected to and extending radially outwardly from said seal structure that permits movement of said seal structure relative to said body portion between said seal position and said open position and mechanical coupling structure radially inward of said annular seal lip for mechanical attachment to package manipulating apparatus for moving said seal structure between said latched and said open positions.

14. A sealed disposable reagent storage package comprising a body portion including structure defining a central compartment and an annular compartment surrounding said central compartment, said body portion including structure interconnecting said compartments and annular ridge structure between said compartments; reagent material in at least one of said compartments, each said compartment being upwardly open and rotationally symmetrical such that contents of said central compartment may be transferred to said annular compartment by centrifugal force, each of said compartments having a volume of less than five cubic centimeters, said central compartment having an annular wall surface that slopes upwardly and outwardly at an angle of at least about ten degrees; and an imperforate cover portion sealingly attached to said body portion so that a sealed enclosure that houses said compartments and said reagent is provided, said imperforate cover member being formed of probe puncturable polymeric material, annular seal structure carried by said cover portion and movable between a seal position in sealing engagement with said annular ridge structure that prevents flow of material between said central and annular compartments and an open position spaced from said annular ridge structure that allows flow of material over said annular ridge structure between said central and annular compartments while said package remains sealed, said seal structure including an annular seal lip for engagement with said outwardly sloping wall surface of said central compartment, said cover and body portions including cooperating recess and projection portions for latching said seal lip in sealing engagement with said sloping wall surface, and an annular flexible web connected to and extending radially outwardly from said seal lip that permits movement of said seal lip relative to said body portion between said latched and open positions.

* * * * *